United States Patent [19]

Meuresch et al.

[11] Patent Number: 4,613,061

[45] Date of Patent: Sep. 23, 1986

[54] VALVE FITMENT FOR A TWO-CHAMBER COMPRESSED GAS PACKAGING MEANS

[75] Inventors: Herbert Meuresch; Wolfgang Fuhrig, both of Wiesbaden, Fed. Rep. of Germany

[73] Assignee: Deutsche Prazisions-Ventil GmbH, Hattershem/Main, Fed. Rep. of Germany

[21] Appl. No.: 611,006

[22] PCT Filed: Oct. 6, 1983

[86] PCT No.: PCT/EP83/00261

§ 371 Date: May 17, 1984

§ 102(e) Date: May 17, 1984

[87] PCT Pub. No.: WO84/01557

PCT Pub. Date: Apr. 26, 1984

[30] Foreign Application Priority Data

Oct. 8, 1982 [DE] Fed. Rep. of Germany ..... 3237263

[51] Int. Cl.[4] ..... B67B 7/24

[52] U.S. Cl. ..... 222/82; 222/135; 222/402.25; 222/541

[58] Field of Search ..... 222/80–83.5, 222/88–90, 129, 134, 135, 136, 145, 402.1, 402.24, 402.25, 501, 518, 541, 402.11, 402.13, 402.16

[56] References Cited

U.S. PATENT DOCUMENTS

| | | | |
|---|---|---|---|
| 3,080,094 | 3/1963 | Modderno | 222/82 |
| 3,134,505 | 5/1964 | Modderno | 222/82 |
| 3,255,924 | 6/1966 | Modderno | 222/82 |
| 3,603,483 | 9/1971 | Morane et al. | 222/82 |
| 4,340,155 | 7/1982 | Obrist | 222/135 |
| 4,469,252 | 9/1984 | Obrist | 222/135 |

FOREIGN PATENT DOCUMENTS 1308036 9/1962 France .

*Primary Examiner*—Joseph J. Rolla
*Assistant Examiner*—Michael S. Huppert
*Attorney, Agent, or Firm*—Davis Hoxie Faithfull & Hapgood

[57] ABSTRACT

A valve fitment (3) for a two-chamber compressed gas packaging container with product components in an inner and an outer container (1, 2) for mixing thereof in the outer container (1) before discharge of the mixture has a discharge pipe (6) which is sealingly axially displaceably guided in an opening (17) in a cover (7) of the outer container (1), which is smaller than the outside diameter, for simultaneously piercing a wall portion (5) of the inner container (2), and a valve (11, 14) which is actuable to release the mixture. In order to ensure that discharge cannot take place before the mixing operation, the cover, for coupling the inner container in position, internally carries a coupling (8) which is disposed around the discharge pipe and which has product through-flow openings (23, 27), wherein the valve can be actuated by displacement of the discharge pipe from the outer limit position in which the valve is closed, by way of an intermediate position in which the wall portion of the inner container is pierced and the valve is still closed, into the other limit position in which the valve is opened.

14 Claims, 8 Drawing Figures

VALVE FITMENT FOR A TWO-CHAMBER COMPRESSED GAS PACKAGING MEANS

Figure 1:
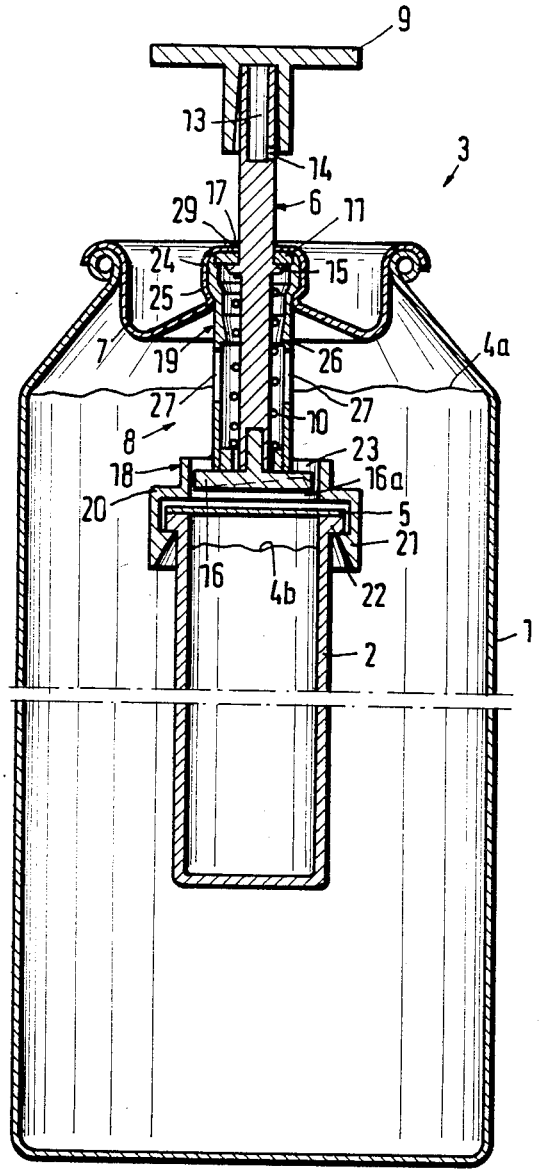

The invention relates to a valve fitment or insert for a two-chamber compressed gas packaging means for separately storing two components of a product, in an inner and an outer container, and for mixing the components within the outer container directly before discharge of the mixture, comprising a cover which has a discharge pipe in a central through opening, for closing an opening of the outer container, which is smaller than the diameter of the outer container, comprising a resilient annular seal which seals the discharge pipe against the through opening and in which the discharge pipe is guided for axial displacement from an outer limit position into an inner limit position, for piercing a wall portion of the inner container, and comprising a valve which is manually actuable for triggering discharge of the mixture.

In a known valve fitment or insert of that kind (U.S. Pat. No. 3 134 505), a valve having a valve stem and a valve seat is formed in the outer end portion of the discharge pipe, one end of the valve stem being extended out of the discharge pipe and carrying a cap nut. Disposed one above the other between the nut and the edge of the cover are a spacer member and a discharge cap which is provided with a discharge nozzle, in order to hold the discharge pipe in its outer limit position. After the spacer member is removed, the pipe can be pushed further into the outer container, in which case the bottom pointed edge of the opening thereof pierces an upper wall portion of the inner container. In the inward limit position, the discharge cap is seated in the substantially plate-shaped cover, the cap enclosing the outer end of the discharge pipe. In that limit position, the components which are contained in the inner and the outer containers can be mixed. Thereupon, the cap nut is at least partially slackened so that the valve stem can be displaced and the valve opened. That arrangement does not ensure that discharge of the content of the outer container is not triggered off before it is mixed with the other component of the mixture, as release of the nut and the thus opening of the valve can occur, intentionally or unintentionally, before the components of the product are mixed.

The invention is based on the problem of providing a valve fitment of the general kind set forth, which ensures that discharge of the mixture cannot take place before the components of the product are mixed.

According to the invention, that problem is solved in that, on its inside, the cover has a coupling means which is disposed around the discharge pipe and which has through openings for the components of the product, for coupling the inner container to the cover, and that the valve can be actuated by displacement of the discharge pipe from the outer limit position in which the valve is closed, by way of an intermediate position in which the wall portion of the inner container is pierced and the valve is still closed, into the inner limit position in which the valve is opened.

With that construction, the valve can necessarily be opened only after the components of the product have been mixed. The valve insert can therefore be used for outer containers wherein a cylindrical container portion and a substantially conically tapering upper portion of the container are made in one piece, as is the case with most of the aerosol cans which are produced at the present time. That is possible because of the act that the inner container can be coupled to the cover so that the inner container does not need to be supported and centred in the outer container. The inner container may be of such a small diameter that it can be passed through the opening in the outer container, which is subsequently closed by the cover. At the same time, the coupling means ensures that there is a defined distance between the wall portion, which is to be pierced, of the inner container, and the lower end of the discharge pipe, in the limit position thereof, irrespective of the respective axial length of the inner container.

The annular seal can then be an annular disc which is mounted between the inside of the cover and the end of the coupling means which is joined to the cover, and the discharge pipe can be guided for axial movement in the coupling means. That arrangement ensures that the annular seal is axially secured in position in a simple manner, with the seal being of a simple configuration. Nonetheless, a high level of sealing is ensured as the fact that the discharge pipe is guided by the coupling means prevents the discharge pipe from tipping or tilting, and thus prevents the content of the outer container from escaping before it is mixed with the other component of the product, by virtue of a leak.

Preferably, the invention then provides that the discharge pipe is closed at the end which is towards the inner container, and has a radial valve opening which co-operates with the annular disc as a valve means, the valve opening being disposed in the intermediate position of the discharge pipe in the vicinity of the inward side of the annular disc.

With that construction, the annular seal acts at the same time as a valve closure member, so that there is no need for a valve stem.

The discharge pipe may then be provided at its inner end with a cutting disc having at least one cutting means at its peripheral edge, the cutting means facing towards the inner container. The cutting disc provides for the immediate formation of a large hole in the wall portion of the inner container which faces towards the cutting disc, wherein the content of the inner container can rapidly issue through the hole formed in the wall portion and mix with the content of the outer container as soon as the discharge pipe has attained its intermediate position. The discharge pipe can accordingly be shorter than in the case of the valve fitment of the general kind set forth above, in which the inner end portion of the discharge pipe is surrounded by an annular disc at a spacing from the inner end of the pipe, in order to enlarge the opening formed by said end in the inner container.

A further development may then provide that the coupling means has a first coupling member which can be brought into engagement with the inner container and a second coupling member which is engaged with the cover, the first and second coupling members being axially fixedly connected, and that on its inward side the first coupling member has an undercut configuration, a corresponding undercut configuration at the periphery of the discharge pipe being urged into contact with the undercut portion of the first coupling member, in the intermediate position, by the pressure of a return spring which acts in a direction towards the outer limit position. That arrangement ensures that the discharge pipe cannot be returned to the outer limit position after the inner container has been pierced.

The invention can then provide that the first coupling member is substantially in the form of a cap member which form-lockingly or positively engages over the inner container and which has through openings in the end portion thereof and which at the same time forms an end portion of the second coupling member, against which the return spring bears. That kind of connection, for example a snap connection or a screw connection, between the first coupling member and the inner container, provides for ease of assembly of the arrangement, for example automatically, while nonetheless ensures that the two components are firmly held together. However, the content of the inner container, after the wall portion thereof has been pierced, can unimpededly discharge through the openings in the cap member, in order to mix with the content of the first container. At the same time, the end portion of the cap member performs a support function for the return spring.

The coupling members can be produced separately and fixedly held together by a push-in or plug-type connection. That makes it easy to produce the coupling means from plastics material in a mould, while avoiding difficulties with regard to removing the components from the mould.

In this arrangement, the second coupling member may have through openings in the form of axially continuous slots, towards the first coupling member, and may engage by a radial spring bias action into an annular groove in the first coupling member. In that way, the coupling members can be easily joined together by being pushed together. However, they are axially securely interconnected by a high frictional force. The slots provide on the one hand for a spring action in respect of the fingerlike limb portions which remain between the slots, while on the other hand they permit the components of the product to pass therethrough.

The cutting plate or disc may also have through-flow openings which radially overlap through-flow openings which are formed on both sides of the annular groove in the end portion of the first coupling member. That ensures substantially unimpeded discharge of the content of the inner container, after that container has been opened.

The invention can then provide that an actuating cap can be fitted to the outside of the cover, by the edge of the opening of the cap, in such a way that the edge of a central outlet opening in a central actuating portion of the actuating cap is carried on the outer open end of the discharge pipe, and that the actuating member is pivotally mounted to the outer part of the actuating cap. That actuating cap permits the valve to be easily opened by pivoting the actuating member by means of the thumb or a finger of the same hand as that holding the compressed gas packaging means.

It is also particularly advantageous for a desired-rupture connection to be provided between the edge of an aperture in the end portion of the actuating cap, and the actuating portion, for a protective cap member which covers the actuating cap fixedly to surround the peripheral wall of the actuating cap by means of a tear-off portion of the edge of the opening, the axial length thereof corresponding to the stroke travel of the discharge pipe from its outer limit position into its intermediate position, and for the protective cap member to bear against the actuating member. With that arrangement, after the edge portion of the opening has been torn off by a pressure, for example a blow, to the protective cap member, the latter can be displaced only the above-mentioned stroke travel, and therewith the discharge pipe can be positively displaced from the limit position initially only into the intermediate position in which the inner container is pierced but the valve is not yet opened.

In that connection, the outlet opening may be formed in the bottom portion of a depression or recess in the inward side of the actuating member, which depression or recess pivotally engages over the outer end of the discharge pipe. On the one hand, the depression or recess provides for centering of the actuating member relative to the discharge pipe, and vice-versa, while on the other hand it permits pivotal movement of the actuating member, with axial displacement of the discharge pipe, without the discharge pipe itself tilting.

The invention can also provide that the depression or recess engages rotatably over the outer end of the discharge pipe, that the actuating member has two portions which extend diameterically with respect to its axis of rotation, one said portion being of an axial thickness which is greater than the other portion by more than the above-mentioned stroke travel, with the thickness of said other portion being smaller than the axial stroke travel, and that the aperture in the end portion of the actuating cap extends besides that one portion over a larger range of angle of rotation of the actuating member, than said one portion. In that construction, after the actuating member has been moved by displacement of the cap member, thereby tearing its connection to the outer portion of the actuating cap, into the intermediate position, the actuating member can be rotated relative to the outer portion of the actuating cap so that the one portion of the actuating member projects further axially outwardly beyond the outer portion of the actuating cap, whereas the other portion of the actuating member lies pivotally underneath the outer portion of the actuating cap. Although the actuating member is therefore no longer connected to the actuating cap, it is nonetheless mounted pivotally only against the pressure of the return spring, in order to provide for opening of the valve by axial movement of the discharge pipe.

The periphery of the coupling end portion which is towards the cover may then be provided with axial ribs which are enclosed by an edge portion of the central through opening in the cover, which accommodates the discharge pipe with clearance therefrom, thereby leaving axial through-flow passages or ducts, and the end face of the one coupling end, which is towards the annular seal that is in the form of an annular disc, can be radially outwardly bevelled. That design configuratin permits the outer container to be easily filled with pressure gas by connecting the filling head of a conventional filling apparatus, in which case the resilient annular seal is compressed at its outer peripheral edge and opens an inlet passage for the pressure gas.

Figure 1A:
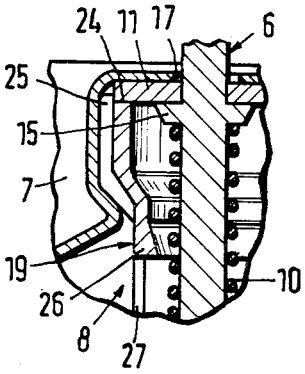
Figure 2:
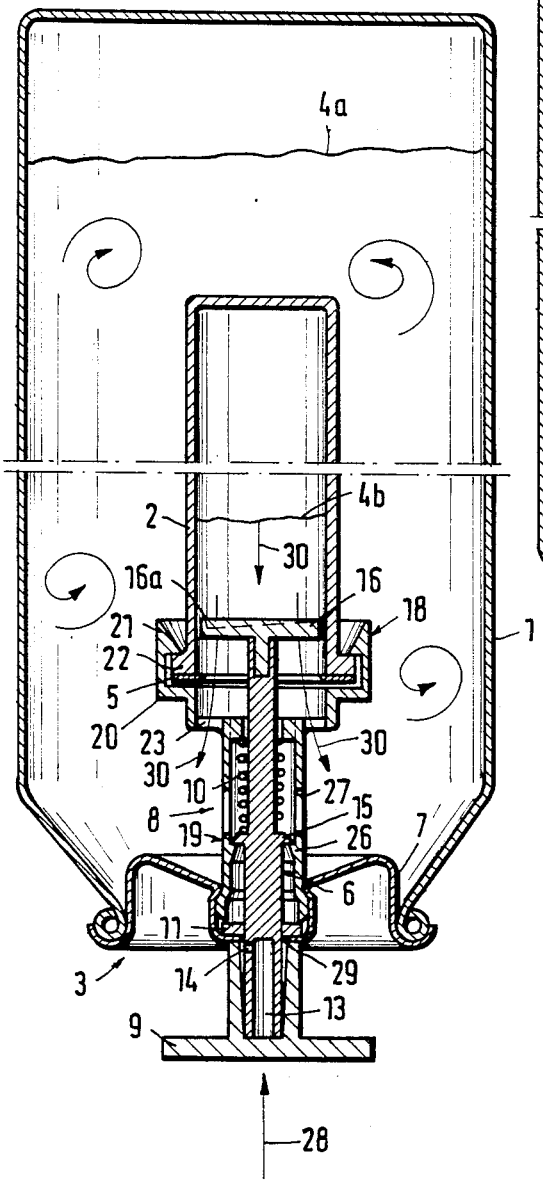
Figure 3:
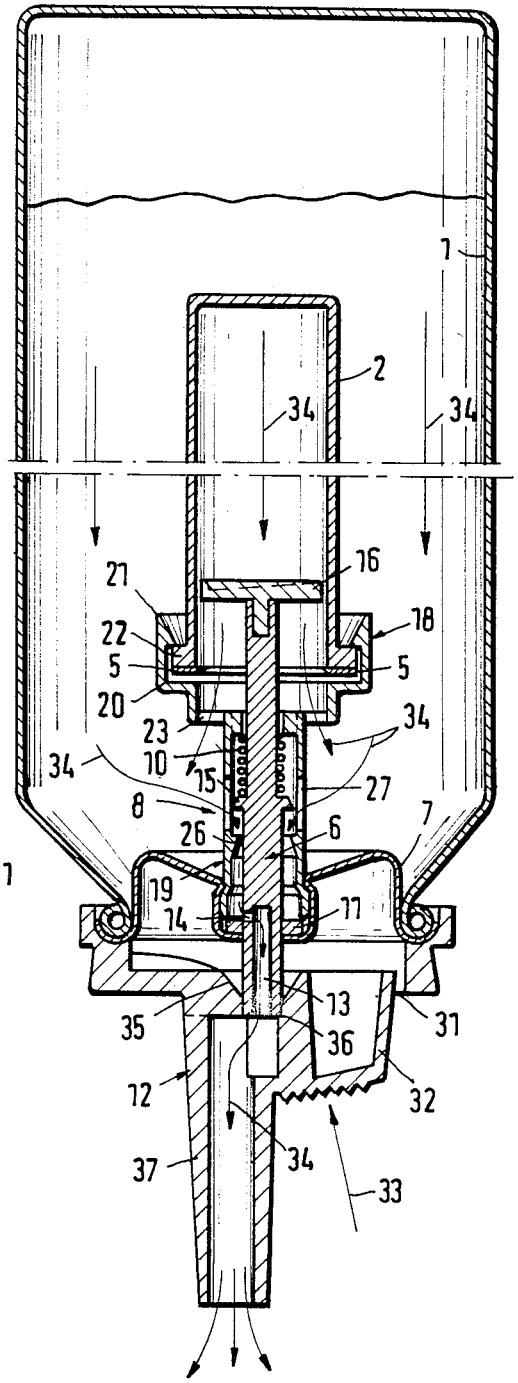
Figure 4:
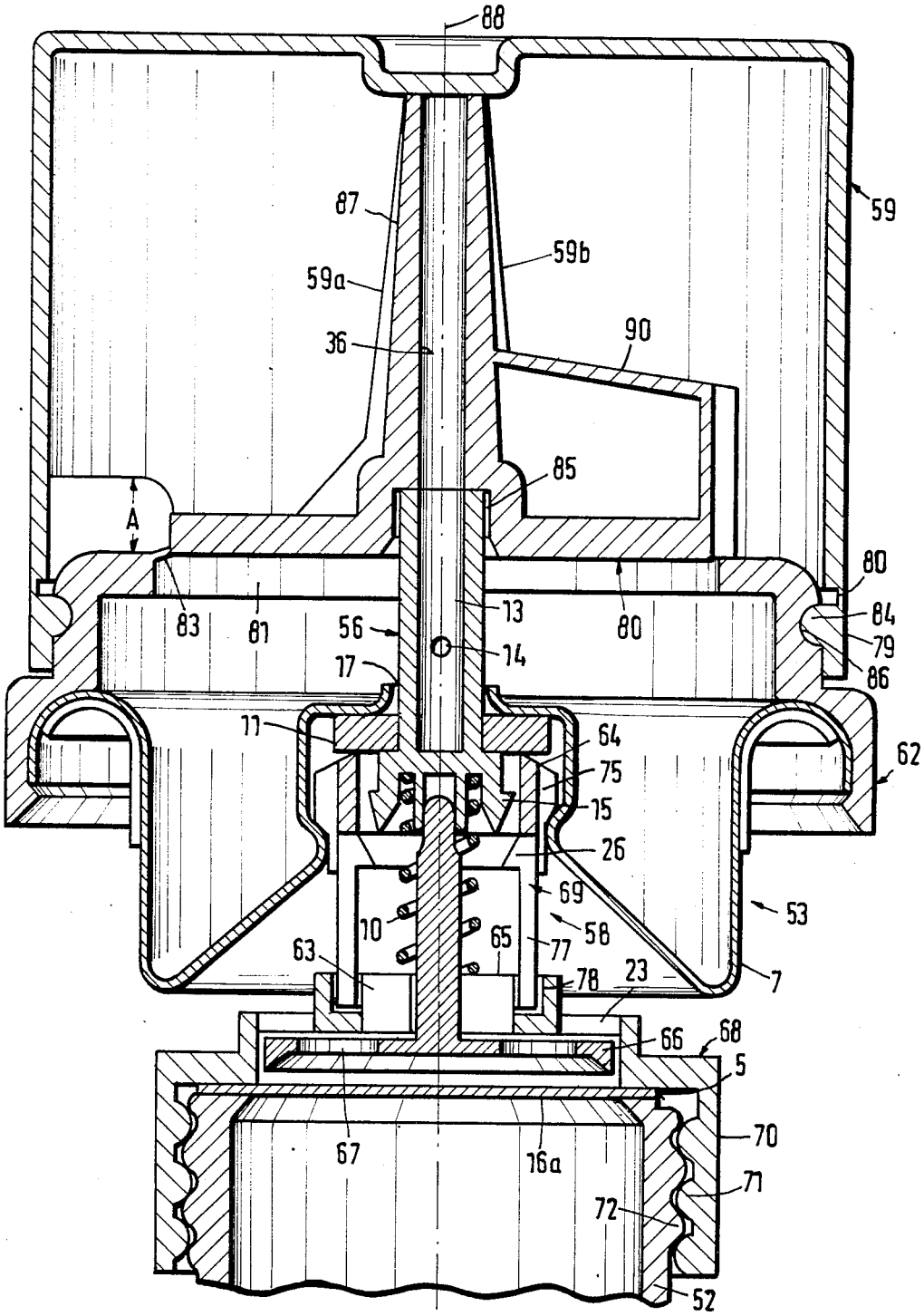
Figure 5:
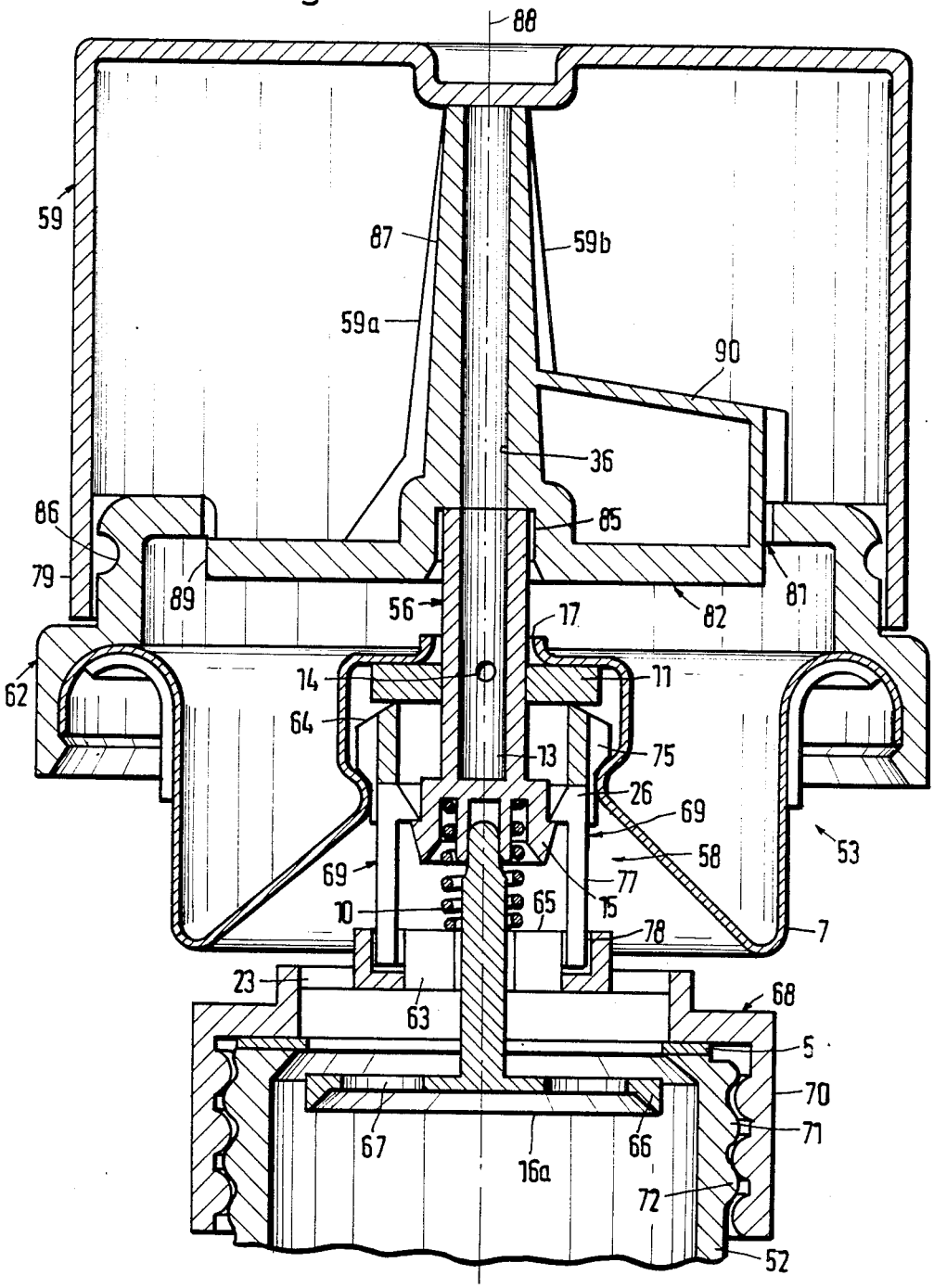
Figure 6:
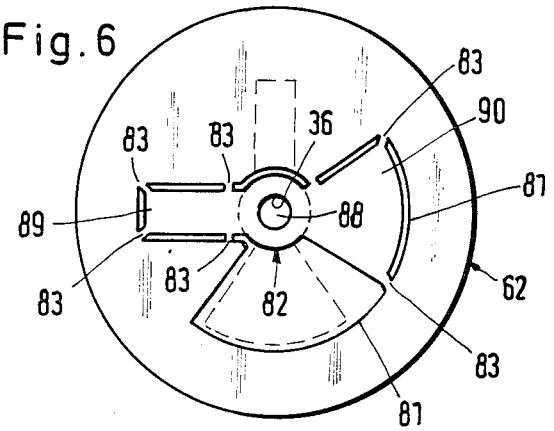
Figure 7:
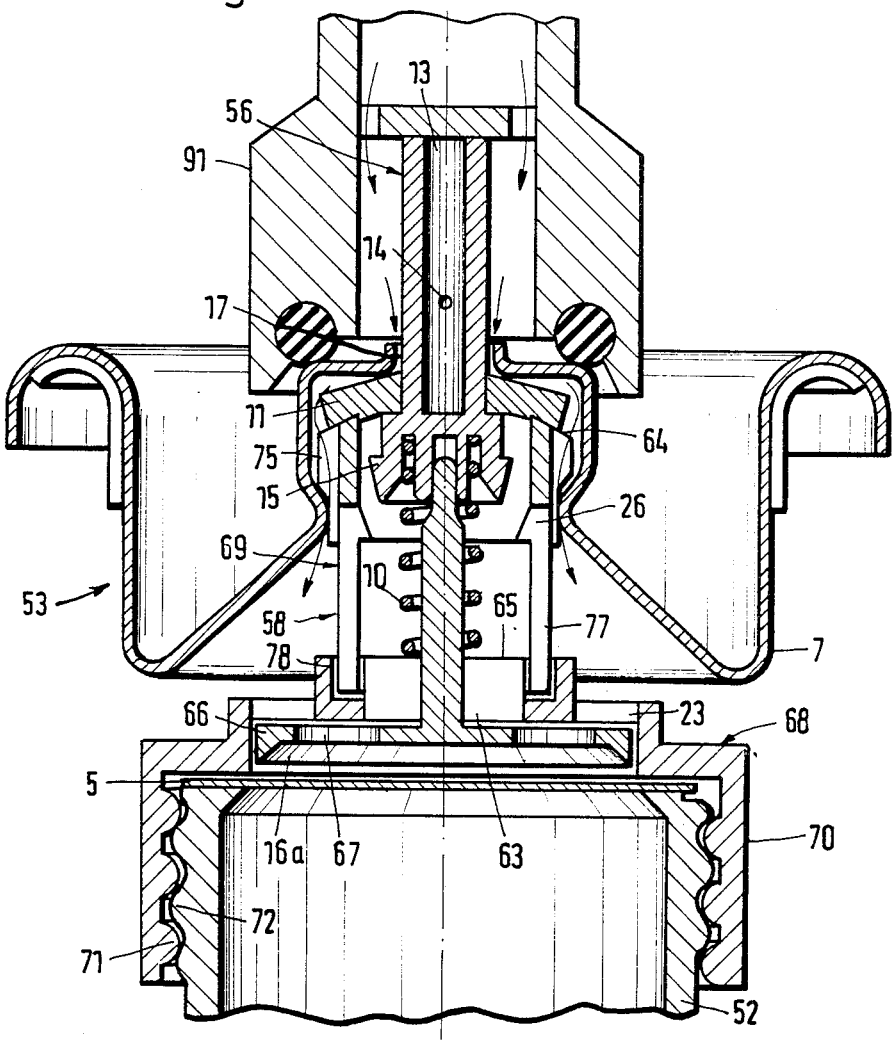

The invention and the developments thereof will be described in greater detail hereinafter with reference to the drawings showing preferred embodiments. In the drawings:

FIG. 1 shows a view in axial section of a two-chamber compressed gas packaging means with a valve fitment according to the invention, in the rest or transportation position, FIG. 1*a* shows a part of the FIG. 1 construction on a larger scale, FIG. 2 shows the two-chamber compressed gas packaging means shown in FIG. 1, in an intermediate position of the discharge pipe, in which the components of the product are mixed, FIG. 3 shows the discharge position of the two-chamber compressed gas packaging means shown in FIG. 1, FIG. 4 shows a view in axial section of another embodiment of a two-chamber compressed gas packaging means with a modified valve fitment according to the invention, in the rest or transportation position, FIG. 5 shows the two-chamber compressed gas packaging means of FIG. 4 with the discharge pipe in an intermediate position in which the components of the product are mixed, FIG. 6 shows a plan view of an actuating portion of the valve fitment shown in FIG. 4, and FIG. 7 shows the two-chamber compressed gas packaging means of FIG. 1 in the condition in which the outer container is being filled with pressure gas.

Referring to FIGS. 1 to 3, the two-chamber compressed gas packaging means comprises an outer container 1, an inner container 2 which is disposed in the outer container 1, and a valve fitment 3.

The containers 1 and 2 each contain a respective fluid component 4*a* and 4*b*, which are under a gas pressure, that is to say, an active substance and an activator, in predetermined amounts. The components 4*a* and 4*b* of the product are completely mixed together before being discharged in the outer container 1 so that they are put to use in an accurately defined mixing ratio. In order to provide for mixing of the components, a wall portion 5, in this case a closure film or foil, of the inner container 2 is ruptured by means of the valve fitment 3 and the component 4*b* is released from the inner container 2 into the outer container 1 which is still in a closed condition.

The valve insert or fitment 3 comprises a discharge pipe 6, a cover 7, a coupling means 8 for connecting the inner container 2 to the cover 7, a protective cap member 9, a spring 10, an annular seal 11 and an actuating cap 12 (see FIG. 3).

In its outer end portion, the pipe 6 is provided with an axial outlet passage or duct 13 which, before discharge, is closed at the outer end by the protective cap member 9. At the other end, the passage 13 communicates with a radial valve opening 14. The protective cap member 9 covers the pipe 6 approximately as far as the valve opening 14. In the middle portion, the pipe 6 has an undercut configuration as indicated at 15, in the form of an annular bead which is bevelled or chamferred at its peripheral surface. At its inward end, the pipe 6 is provided with a cutting disc or plate 16 which, at the peripheral edge, has a cutting means or cutting edge 16*a* which faces toward the closure film or foil 5 and which is possibly interrupted in the peripheral direction. The diameter of the disc 16 is somewhat smaller than the opening of the container 2, which is closed by the closure foil 5.

The substantially plate-shaped cover 7 (also referred to as a valve plate) is fitted into the opening of the container 1 and its outer edge is fluid-tightly and pressure-resistingly joined to the turned-over edge portion around the opening of the container 1. In the centre, the cover 7 is provided with a through opening 17 through which the pipe 6 is passed, with clearance.

The coupling means 8 comprises a first coupling member 18 which can be brought into engagement with the inner container 2, and a coupling member 19 which is engaged with the cover 7.

At the inner end, the coupling member 19 has a cap member 20 which is interrupted to form a plurality of segment-like portions, by axial slots in the side wall, the cap member 20 comprising a plurality of resilient holding claws 21 which are provided with an undercut configuration as a holder for mounting the container 2, the edge of the opening of which has a radially projecting annular flange 22 which engages behind the undercut configuration. The connection between the container 1 and the coupling member 18 may also be in the form of a bayonet-type connection. Formed in the end portion or bottom of the cap member 20 are through-flow openings 23 which, when the closure foil 5 is pierced, permit the component 4*b* to pass into the container 1. The pipe 6 is then passed through a central bore in the end portion of the cap member 20, with the pipe 6 being guided laterally thereof.

At the free end which is towards the cover 2 (see in particular FIG. 1*a*), in an inward direction, the coupling member 19 has a cylindrical recess 24 (shoulder) for carrying the annular disc 11 and, on its outward side, a plurality of axial ribs 25 which are spaced apart in the peripheral direction, for the operation of introducing the pressure gas. The end portion of the coupling member 19, which carries the ribs 25, is enclosed by the edge portion, that adjoins the opening 17, of the cover 7, with through-flow passages or ducts being left between the ribs 25, so that the coupling member 19 is secured to the cover 7. On its inward side, the coupling member 19 then has an annular bead which forms an undercut configuration as indicated at 26 and the inside diameter of which is slightly smaller than the outside diameter of the annular bead 15. Therefore, the annular beads 15 and 26 can be moved past each other, undergoing deformation when that happens, upon inward displacement of the pipe 6. In addition, the coupling member 19 is provided with through-flow openings 27 in the form of axial slots.

As shown in FIG. 2, the closure foil or film 5 is pierced by the pipe 6 being pressed thereinto, by a pressure or a striking force being applied to the protective cap member 9 in the direction indicated by the arrow 28, until the edge of the opening of the protective cap member 9 bears against the edge 29 of the opening 17 so that the content of the container 2 issues in the direction indicated by the arrows 30, flowing past the cutting plate 16 (or through through-flow openings which are possibly formed therein) and through the flow openings 23 into the container 1, and can be completely mixed with the content of the container 1 by shaking the container 1 in the inverted position shown in FIG. 2.

With the pipe 6 in the outward limit position shown in FIG. 1, the spacings of the protective cap member 9 and the valve opening 14 from the edge 29 of the cover 7 and the spacing of the undercut portions 15 and 16 from each other are approximately equal and are of such a magnitude that, in the intermediate position shown in FIG. 2, on the one hand the closure foil or film 5 is pierced and on the other hand the portions 15 and 16 are latched together, wherein the spring 10 which is disposed around the pipe 6 and which bears at one end against the annular bead 15 and at the other end against the bottom or end portion of the cap member 20 urges the portions 15 and 26 together and the valve opening 14 still remains outside the inward side of the annular disc 11. With the pipe 6 in that intermediate position, the valve which is formed by the annular disc 11 and the valve opening 14 is consequently still closed so that the product mixture still cannot issue from the container 1.

It is only after the protective cap member 9 which is a frictional fit on the outer end of the pipe 6 has been removed, the actuating cap 12 (see FIG. 3) has been fitted on to the outer edge of the cover 7 by a snap fit, and a central actuating portion 32 of the cap 12, which actuating portion is mounted in an opening 31 in the end portion of the actuating cap 12, has been depressed in the direction indicated by the arrow 33, that the mixture is free to issue from the containers 1 and 2 in the direction indicated by the flow arrows 34 as soon as the valve opening 14 takes up a position on the inward side of the annular disc 11. For that purpose, on its inward side, the actuating cap 12 has an insertion depression or recess 35 having an outlet opening 36 which receives the outer end of the pipe 6 and which communicates with a discharge duct or conduit 37 which extends the pipe 6.

In the second embodiment shown in FIGS. 4 to 7, the two-chamber compressed gas packaging means comprises an outer container (not shown) which corresponds to the outer container 1 shown in FIG. 1, an inner container 52 which is disposed in the outer container, and a valve insert or fitment 53.

The containers also each contain a respective fluid component (not shown) which is under a gas pressure, for example an active substance and an activator, in predetermined amounts, with those components being completely mixed together in the outer container before discharge thereof, so that they are put to use with the components in a precisely defined mixing ratio. In order to permit the components to be mixed, the wall portion 5, in this case once again a closure film or foil, of the inner container 52, is ruptured by means of the valve fitment 53 and the components of the product are discharged from the inner container 52 into the outer container which is still in a closed condition.

The valve fitment 53 comprises a discharge pipe 56, the cover 7, a coupling means 58 which connects the inner container 52 to the cover 7, a protective cap member 59, the spring 10, the annular seal 11 and an actuating cap member 62.

In its outer end portion, the pipe 56 is provided with an axial discharge passage or duct 13 which is open at the outer end and which communicates with the radial valve opening 14. The protective cap member 59 covers the actuating cap 62 which in turn is carried on the outer edge of the cover 7 and is latched thereto. In the central region, the pipe 56 has an undercut portion 15 in the form of an annular bead which is bevelled or chamfered at the peripheral surface thereof. At the inner end, the pipe 56 is provided with a cutting disc or plate 66 which, at the peripheral edge, has the cutting edge or cutting means 16*a* which faces towards the closure foil 5 and which is possibly interrupted in the peripheral direction. The diameter of the cutting disc 66 is somewhat smaller than the opening of the container 52, which is covered by the foil 5, and it has through-flow openings 67.

The cover 7 is mounted to the outer container in the same way as in the embodiment shown in FIG. 1 and is provided at its centre with the through opening 7 through which the pipe 56 is passed, with clearance.

The coupling means 58 comprises a first coupling member 68 which can be brought into engagement with the inner container 52, and a coupling member 69 which is engaged with the cover 7. At its inner end, the coupling member 68 has a cap member 70 with internal screwthread 71 as a holder for carrying the inner container 52, the edge of the opening of which has an external screwthread 72 which engages into the internal screwthread. The through openings 23 are again formed in the bottom or end portion of the cap member 70. The pipe 56 is passed through a central bore in the bottom or end portion of the cap member 70, with the pipe 56 being guided at its sides. The bore is delimited by radial ribs or web portions 65 which delimit further axial through-flow openings 63. Both the openings 23 and the openings 63 are radially overlapped by the openings 67.

At the free end which is towards the cover 7, the coupling member 69 has an inwardly bevelled or chamferred conical end surface 74 for contacting the annular disc 11, while on its outside, it has a plurality of axial ribs 75 which are spaced apart in the peripheral direction, for the operation of introducing the presssure gas. The end portion of the coupling member 69, which bears the ribs 75, is enclosed by the edge portion of the cover 7, which adjoins the opening 17, leaving the through-flow passages between the ribs 75, so that the coupling member 69 is secured to the cover 7. The coupling member 69 also has the undercut portion or configuration 26 on its inside. In addition, the coupling member 19 is provided with through openings 77 in the form of axially continuous slots which, by virtue of radial spring biasing, engage into an annular groove 78 on the top side of the coupling member 68, between the openings 23 and 63, so that the coupling members 68 and 69 are connected together by a frictional lock. It is however also possible to use a latching push-in type connection, instead of the frictionally locking push-in connection just described above.

As shown in FIG. 4, the protective cap member 59 has a tear-off edge portion 79 around its opening, which is connected to the main portion of the protective cap member 59 by a desired-rupture connecting means indicated at 80 in the form of desired-rupture web portions. The axial length of the edge portion 79 approximately corresponds to the spacing of the valve opening 14 from the annular disc 11 in the outward limit position of the pipe 56. In addition, on its inside, the protective cap member 59 has projections 59*a* and 59*b* in the form of ribs. The ribs bear against an actuating member 82 which is secured in an opening 81 in the actuating cap 62 by means of a desired-rupture connecting means 83 in the form of desired-rupture web portions. In that arrangement, the projections 59*a* and 59*b*, radially outwardly of the actuating member 82 in the limit position shown in FIG. 4, are at an axial spacing A from the actuating cap 62 which is at least equal to the axial length of the edge portion 79. On its inside, the actuating member 82 has a depression or recess 85, in the bottom of which is formed the outlet opening 36 for the product mixture. The recess 85 engages rotatably over the outer end of the pipe 56, with clearance therein, and is extended in a discharge pipe or conduit 87 which extends the pipe 56. The protective cap member 59 is also supported with its end or bottom portion by way of the conduit 87 on the actuating portion 82 so that the projections 59*a* and 59*b* can be omitted. However, they assist with centering of the protective cap member 59, particularly after the edge portion 79 has been removed. Conversely, the conduit 87 could also be omitted and the protective cap member could be supported on the actuating portion 82 directly or by way of correspondingly shorter projections.

The protective cap member 59 is axially secured on the actuating cap 62 by an annular bead 84 (see FIG. 4) which engages into an annular groove 86 on the outside of the peripheral wall of the actuating cap 82.

As shown in FIGS. 4 to 6, more particularly FIG. 6, the actuating member 82 has two portions 89 and 90 which extend diametrically with respect to its axis of rotation and of which one portion 90 is of an axial thickness which is greater than the thickness of the other portion 89 (see FIG. 5) by more than the above-mentioned distance (A) or stroke travel movement of the pipe 56 between the outer limit position and the intermediate position. The thickness of the portion 89 is less than the above-mentioned axial stroke travel and the opening 81 in the bottom of the actuating cap 62 extends beside the portion 90 over a greater rotary angular region of the actuating member 82, than said portion 90.

During storage or transportation, the actuating cap 62 and the protective cap member 59, which is in an intact condition, are fitted to the cover 7 in the position shown in FIG. 4, so that the pipe 56 is in the outward limit position shown in FIG. 4.

In order for mixing of the components contained in the containers to occur, the edge portion 79 is first torn off the protective cap member 59 and the protective cap member 59 is pressed towards the cover 7, finally coming to bear on the outer part of the actuating cap 62. In that inward movement, the actuating member 82 and the pipe 56 are simultaneously displaced inwardly, with the web portions 83 being torn off as that happens, while the cutting disc 66 pierces the cover foil 5 in the vicinity of the inner edge of the opening of the inner container 52. After that first inward movement, the parts 59, 82 and 56 are in the intermediate position shown in FIG. 5, in which the valve 11, 14 is still closed but the content of the container 52 can pass out into the outer container and can be completely mixed therewith by shaking. No further inward movement is possible with the arrangement in the intermediate position, as long as the protective cap member 59 is supported on the outer part of the actuating cap 62 and, by way thereof, on the cover 7. It is only after the protective cap member 59 has been removed from the actuating cap 62 that the actuating member 82 can be pressed further inwardly. However, before the actuating member 82 is pressed further inwardly, it can be rotated, in the intermediate position shown in FIG. 5, approximately through 90°, into the position shown in broken lines in FIG. 6. In that position, the portion 89 is underneath the bottom or end portion of the cap 62. If now a pressure is applied to the portion 90 of the actuating member 82, the actuating member is pivoted, while the portion 89 bears against the underside of the bottom or end portion of the cap 62. The pivotal movement of the actuating member 82 causes axial displacement of the pipe 56 which is guided on the one hand by the annular disc 11 and on the other hand by the coupling member 68 between the ribs 65, until the pipe 56 moves into an inward limit position (not shown) in which the valve opening 14 is disposed on the inside of the annular disc 11 and the valve is opened. The content of the outer container can then issue unimpededly by way of the slots 77, the valve opening 14, the passage 13 and the pipe 37, as long as a pressure is applied to the portion 90 of the actuating member 82.

For the purposes of fitting the valve insert or fitment 59, the pipe 56 is first pre-assembled, with the annular disc 11 and the spring 10, and then (with the arrangement in the inverted position) inserted into the hole 17 in the cover 7. After the coupling member 69 which is completely open downwardly has been fitted into place, the cover 7 is compressed beneath the wider part of the ribs 75 so that the cover 7 engages around that part of the ribs. The inner part of the pipe 56 which carries the cutting disc 66 is then initially pre-assembled, with the cap member 70 of the coupling member 68, with that part of the pipe being held in the cap member 70 by friction. That pre-assembled unit is then pressed with the pointed end of the lower part of the pipe leading, into an axial bore in the upper part of the pipe, in which case the pointed end is fixed in the bore by a frictional lock (in addition or instead however, it is also possible to provide a latching or detent-type connection). At the same time, the end portion of the coupling member 69, which has the slots 77, engages into the annular groove 68 where it is secured by frictional lock. If desired, that frictional lock could be further strengthened for example by ultrasonic welding of the coupling members which comprise plastic synthetic material.

With the arrangement in that condition, the pre-assembled valve insert or fitment is packaged and supplied to the filling station. There, the inner container 52 is filled with one component of the mixture and then its threaded neck is closed with a closure foil or film which is for example aluminium-lined, by adhesive or by welding. The filling station now fills the outer container with the second component of the mixture and then fits the valve insert of fitment in the opening of the outer container after the inner container 52 has been fixed to the cap member 70 by screwing.

The unit which is fixedly closed by the outer edge of the cover 7 being turned or flanged over around the edge of the opening of the outer container now moves into position in the filling station, under the conventional propellant gas filling means.

As shown in FIG. 7, a filling head 91 of the propellant gas filling means is of such a size that the pipe 56 is not depressed by the operation of fitting the filling head to the arrangement. The propellant gas is then urged by way of the opening 17 and the deforming annular disc 11 between the ribs 75 and into the outer container, as shown by the flow lines in FIG. 7.

Directly after the container has been filled with propellant gas, the filling station fits the combination of the actuating cap 62 and the protective cap member 59 on to the edge of the cover 7. The packaging means is then protected and is rendered secure for transportation thereof. As long as the tear-off edge portion 79 is intact, the customer additionally enjoys a guarantee that the container is still in its original closed condition. The contents of the container can then be discharged in the manner already described above.

Modifications in the illustrated embodiments are within the scope of the invention.

We claim:

1. A valve fitment (3;53) for a two-chamber compressed gas packaging means for separately storing two components (4*a*,4*b*) of a product in an inner container (2;52) and an outer container (1) and for mixing the components within the outer container (1) directly before discharge of the mixture, comprising a cover (7), a discharge pipe (6;56) in a central through opening (17), an opening in the outer container (1), said cover (7) closing the opening in the container (1) and being smaller than the diameter of the outer container, further comprising a resilient annular seal (11) which seals the discharge pipe (6;56) against the through opening (17) and in which the discharge pipe (6;56) is guided for axial displacement from an outer limit position into an inner limit position, for piercing a wall portion of the inner container (2;52), and comprising a valve (11,14) which is manually actuable for triggering discharge of the mixture, characterised in that, on its inside, the cover (7) has a coupling means (8;58) for coupling the inner container (2;52) to the cover (7) which is disposed around the discharge pipe (6;56) and which has through openings (23,27;23,63,77) for the components (4*a*,4*b*) of the product, and that the valve (11,14) can be actuated by displacement of the discharge pipe (6;56) from the outer limit position in which the valve (11,14) is closed, by way of an intermediate position in which the wall portion of the inner container (2;52) is pierced and the valve is still closed, into the inner limit position in which the valve is opened.

2. A valve fitment according to claim 1 characterised in that the annular seal (11) is an annular disc (11) which is mounted between the inside of the cover and the end of the coupling means (8; 58) which is joined to the cover (7) and the discharge pipe (6; 56) is axially displaceably guided in the coupling means (8; 58).

3. A valve fitment according to claim 2 characterised in that the discharge pipe (6; 56) is closed at the end which is towards the inner container and has a radial valve opening (14) which cooperates with the annular disc (11) as a valve, the valve opening being disposed in the intermediate position of the discharge pipe (6; 56) in the vicinity of the inward side of the annular disc (11).

4. A valve fitment according to one of claim 3 characterised in that the discharge pipe (6; 56) is provided at the inner end with a cutting disc (16; 66) having at least one cutting means (16*a*) at its peripheral edge, said cutting means facing towards the inner container (2; 52).

5. A valve fitment according to one of claim 4 characterised in that the coupling means (8; 58) comprises a first coupling member (18; 68) which can be brought into engagement with the inner container (2; 52), and a second coupling member (19, 69) which is engaged with the cover (7), the first and second coupling means being axially fixedly connected, and that on its inward side the first coupling member (18, 68) has an undercut configuration (26), a corresponding undercut configuration (15) at the periphery of the discharge pipe (6; 56) being urged into contact with the undercut configuration of the first coupling member, in the intermediate position, under the pressure of a return spring (10) which acts in a direction towards the outer limit position.

6. A valve fitment according to claim 5 characterised in that the first coupling member (18; 68) is substantially in the form of a cap member which form-lockingly engages over the inner container (2; 52) and which has through-flow openings (23; 23, 63) in the end portion thereof and which at the same time forms an end portion of the second coupling member (16; 69), against which the return spring (10 bears.

7. A valve fitment according to claim 5 characterised in that the coupling members (68, 69) are produced separately and are fixedly held together by a push-in connection.

8. A valve fitment according to claim 6 characterised in that the second coupling member (69) has through openings in the form of axially continuous slots (77), towards the first coupling member (68), and engages with a radial spring bias action into an annular groove (78) in the first coupling member.

9. A valve fitment according to claim 4 characterised in that the cutting disc (66) has through-flow openings which radially overlap through-flow openings (23, 63) which are formed on both sides of the annular groove (78) in the end portion of the first coupling member (68).

10. A valve fitment according to one of claim 1 characterised in that an actuating cap (12; 62) can be fitted on the outside of the cover (7), with the edge of the opening of the cap, in such a way that the edge of a central outlet opening (36) in a central actuating member (32; 82) of the actuating cap (12; 62) is carried on the outer open end of the discharge pipe (6, 56) and that the actuating member (32; 82) is pivotally mounted to the outer part of the actuating cap (12; 62).

11. A valve fitment according to claim 10 characterised in that a desired-rupture connection (83) is provided between the edge of an aperture (81) in the end portion of the actuating cap (62), and the actuating member (82), that a protective cap member (59) which covers the actuating cap (62) fixedly surrounds the peripheral wall of the actuating cap (62) by means of a tear-off edge portion (79) of the opening, the axial length thereof corresponding to the stroke travel movement of the discharge pipe from its outer limit position into the intermediate position, and that the protective cap member (59) bears against the actuating member.

12. A valve fitment according to claim 10 characterised in that the outlet opening (36) is formed in the bottom of a depression (35; 85) on the inward side of the actuating member (32; 82), which depression pivotally engages over the outer end of the discharge pipe (6; 56).

13. A valve fitment according to claim 12 characterised in that the depression (85) rotatably engages over the outer end of the discharge pipe (56), that the actuating member (82) has two portions (89, 90) which extend diametrically with respect to its axis of rotation, of which one portion (90) is of an axial thickness which is greater than the other portion by more than the above-mentioned stroke travel, with the thickness of the other portion being smaller than the axial stroke travel, and that the aperture (81) in the end portion of the actuating cap (82) extends besides that one portion (90) over a larger region of angle of rotation of the actuating member (82), than said one portion (90).

14. A valve fitment according to one of claim 1 characterised in that the periphery of the coupling end portion which is towards the cover (7) is provided with axial ribs (25; 75) which are enclosed by an edge portion of the central through opening (17) in the cover (7), which accommodates the discharge pipe (6; 56) with clearance therefrom, thereby leaving axial through-flow passages, and that the end face (64) of the one coupling end, which is towards the annular seal that is in the form of an annular disc (11), is radially outwardly bevelled.

* * * * *